United States Patent [19]

Yuyama

[11] Patent Number: 5,020,459

[45] Date of Patent: Jun. 4, 1991

[54] BLIND STITCH SEWING MACHINE AND BLIND STITCHING METHOD

[75] Inventor: Kohsuke Yuyama, Yamagata, Japan

[73] Assignee: Suzuki Manufacturing Co., Ltd., Japan

[21] Appl. No.: 401,920

[22] Filed: Sep. 1, 1989

[30] Foreign Application Priority Data

Sep. 14, 1988 [JP] Japan ..... 63-231355

[51] Int. Cl.[5] ..... D05B 1/24; D05B 57/06

[52] U.S. Cl. ..... 112/178; 112/267.1; 112/268.1

[58] Field of Search ..... 112/176, 177, 178, 267.1, 112/268.1

[56] References Cited

U.S. PATENT DOCUMENTS

| | | | |
|---|---|---|---|
| 738,054 | 9/1903 | McNeil et al. | 112/177 X |
| 976,256 | 11/1910 | Fefel et al. | 112/177 |
| 1,014,231 | 1/1912 | Kiewicz | 112/177 |
| 1,042,537 | 10/1912 | Drake | 112/177 |
| 1,351,866 | 9/1920 | Noble | 112/178 |
| 2,894,470 | 7/1959 | Buono | 112/178 |
| 3,288,094 | 11/1966 | Roth et al. | 112/178 |
| 3,572,269 | 3/1971 | Fletcher et al. | 112/178 |
| 3,661,104 | 5/1972 | Fletcher et al. | 112/178 |
| 3,747,546 | 7/1973 | Jurgens | 112/178 |
| 4,114,547 | 9/1978 | Russell | 112/178 |

FOREIGN PATENT DOCUMENTS

| | | | |
|---|---|---|---|
| 136133 | 1/1934 | Fed. Rep. of Germany | 112/178 |

*Primary Examiner*—Werner H. Schroeder
*Assistant Examiner*—Paul C. Lewis
*Attorney, Agent, or Firm*—Lorusso & Loud

[57] ABSTRACT

A blind stitch sewing machine includes a straight needle, a driving mechanism which gives a linear reciprocating motion to the straight needle, a needle guide which prevents the straight needle from sliding on the surface of the work without sticking therein, and a work raising portion formed on a work raising member so that a raised part of the work is continuously raised until it is stuck with the pointed tip of the straight needle and, after the pointed tip of the straight needle has passed the work raising member, the work raising member is withdrawn from the path of the straight needle by a distance not less than the radius of the trunk of the straight needle. Also disclosed is a blind stitching method which comprises employing a straight needle, giving a linear reciprocating motion to the straight needle in a direction which is parallel to the plane in which the work spreads and which is orthogonal to the sewing direction, preventing the straight needle from sliding on the surface of the work without sticking therein, and actuating the work raising member such that, after the pointed tip of the straight needle has passed the work raising member, the work raising member is withdrawn from the path of the straight needle by a distance not less than the radius of the trunk of the straight needle.

10 Claims, 8 Drawing Sheets

BLIND STITCH SEWING MACHINE AND BLIND STITCHING METHOD

BACKGROUND OF THE INVENTION

1. Field of the Invention

The present invention relates to a blind stitch sewing machine and a blind stitching method. More particularly, the present invention pertains to a blind stitch sewing machine and a blind stitching method whereby it is possible to employ a straight needle used in ordinary household sewing machines which is readily produced with high accuracy and at low cost and which sticks in a work stably with a relatively great piercing force and minimizes the possibility that the needle will be deformed or the pointed tip thereof will be damaged during blind stitching. It is therefore possible to obtain a beautiful and high-quality sewn product which has no spotted stitches and it is also possible for laymen such as housewives to perform a blind stitching operation satisfactorily without the need for a high level of skill in sewing and it is unnecessary to pay any more attention to the condition of the needle than is needed for ordinary household sewing machines.

2. Related Art Statement

Blind stitch sewing machines employing a curved needle have heretofore been known [e.g., Japanese Patent Post-Exam Publication Nos. 39-28960 (1964), 43-26076 (1968), 45-20026 (1970), 45-23980 (1970) and 45-37268 (1970), Japanese Patent Laid-Open (KOKAI) No. 58-105786 (1983), U.S. Pat. Nos. 3,760,747, 3,986,469, 4,043,284 and 4,416,207].

This type of conventional blind stitch sewing machine has a driving shaft, a needle activated to perform a circular reciprocating motion by the driving shaft, a looper driven by the driving shaft to perform a somewhat elliptic reciprocating motion in relation to both the needle and the sewing thread such that the looper is inverted at two ends of an elliptical path, a needle plate and a presser foot which clamp a work therebetween, a work raising member which raises a part of the work through an opening provided in the needle plate, and a work holding-down member which holds down the raised part of the work, so that a curved needle is circularly stuck into the raised part of the work, while the thread is caught with the looper so as to form a loop, and the curved needle is entwined with the loop, thereby performing blind stitching by means of a single-yarn chain stitch.

Referring to FIG. 10, a curved needle 3001 used in the above-described prior art has an overall circular configuration. The pointed tip 3002 of the curved needle 3001 is eccentric with respect to the trunk 3003 of the needle 3001 and extends along a circular arc defined by the outer periphery of the curved needle 3001 so that the gap between the tip 3002 and the pointed upper end of the work raising member (not shown) is constant. Therefore, the curved needle 3001 has the advantage that it can pierce the work readily and smoothly.

On the other hand, the curved needle 3001 suffers from the following disadvantages. Namely, the production of such a curved needle is extremely difficult and troublesome. It is likely that there will be variations in the accuracy of needles. The production cost of curved needles is about 5 times that of straight needles for use in ordinary household sewing machines. Since the needle is curved, upon entering a workpiece, the piercing force is relatively weak, and the needle cannot stick in a work stably, so that the needle may be deformed during the blind stitching operation, which leads to spotted stitches and hence deteriorates the quality of the sewn product. In addition, the tip of the curved needle is readily damaged, so that it must frequently be replaced with a new one. Thus, the prior art requires a high level of skill in sewing, so that it is difficult for laymen to perform a satisfactory sewing operation and it is necessary in order to obtain a sewn product of high quality to pay special attention to the condition of the needle.

SUMMARY OF THE INVENTION

The above-described drawbacks in the prior art apparatus have been successfully eliminated by the present invention.

It is an object of the present invention to provide a blind stitch sewing machine and a blind stitching method whereby it is possible to employ a straight needle used in ordinary household sewing machines which is readily produced with high accuracy and at low cost.

It is another object of the present invention to provide a blind stitch sewing machine and a blind stitching method whereby the needle sticks in a work stably with a relatively great piercing force, without the fear that the needle will be deformed or the pointed tip thereof will be damaged during the blind stitching operation. It is therefore possible to obtain a beautiful and high-quality sewn product which has no spotted stitches and it is also possible for laymen such as housewives to perform a blind stitching operation satisfactorily without the need for a high level of skill in sewing and it is unnecessary to pay any more attention to the condition of the needle than is needed for ordinary household sewing machines.

To these ends, the present invention provides a blind stitch sewing machine having a driving shaft, a needle and a looper which are independently driven by the driving shaft, a needle plate and a presser foot which clamp a work therebetween, a work raising member which raises a part of the work through a opening provided in the needle plate, and a work holding-down member which holds down the raised part of the work so that the raised part of the work is pierced by the needle to perform blind stitching, with a single-yarn chain stitch, in cooperation with the looper. The novel sewing machine and method of the present invention employ a straight needle and a driving mechanism, provided between the driving shaft and the straight needle, to give a linear reciprocating motion to the straight needle in a direction which is parallel with the plane in which the work spreads and which is orthogonal to the sewing direction at least during the stitching process.

According to another aspect of the present invention, the blind stitch sewing machine and method further employ a needle guide which prevents the straight needle from sliding on the surface of the work without piercing the work.

According to another aspect of the present invention, the blind stitch sewing machine and method further employ a work raising portion formed on the work raising member so that the raised part of the work is continuously raised until it is pierced by the pointed tip of the straight needle and, after the pointed tip of the straight needle has passed the work raising member, the work raising member is withdrawn from the straight needle by a distance not less than the radius of the trunk of the straight needle.

According to the blind stitch sewing machine and blind stitching method of the invention, it is possible to employ a straight needle of the type used in ordinary household sewing machines which is readily produced with high accuracy and at low cost.

Further, according to the blind stitch sewing machine and blind stitching method of the present invention, it is possible to employ a straight needle and a needle guide which guides the straight needle while pressing it in the direction counter to the direction in which a part of the work is raised by the work raising member, so that the needle is prevented from sliding on the surface of the work and pierces the work without fail. It is therefore possible to employ a ball-point needle which is generally used in ordinary household sewing machines. Since the needle sticks in the work stably with a relatively great pirecing force, there is no fear that the needle will be deformed or that pointed tip thereof will be damaged during a blind stitching operation and it is therefore possible to obtain a beautiful and high-quality sewn product which has no spotted stitches. It is also possible for laymen such as housewives to perform a blind stitching operation satisfactorily without the need for a high level of skill in sewing and it is unnecessary to pay any more attention to the condition of the needle than is needed for ordinary household sewing machines.

Further, according to the blind stitch sewing machine and blind stitching method of the present invention, a straight needle is employed and the work raising member is provided with an edge having an inverted V-shaped cross-section so as to raise a part of the work once per reciprocating motion of the straight needle in such a manner that a part of the work is continuously raised until it is pierced by the pointed tip of the straight needle and, after the pointed tip of the straight needle has passed the inverted V-shaped edge, the work raising member is withdrawn from the path of the straight needle by a distance not less than the radius of the trunk of the straight needle. Accordingly, it is possible to employ an inexpensive needle for an ordinary household sewing machine, without the need to use the previously described curved needle.

DETAILED DESCRIPTION OF PREFERRED EMBODIMENTS

The above and other objects of the invention will become apparent from the following description of embodiments thereof when taken together with the drawings.

Figure 1:
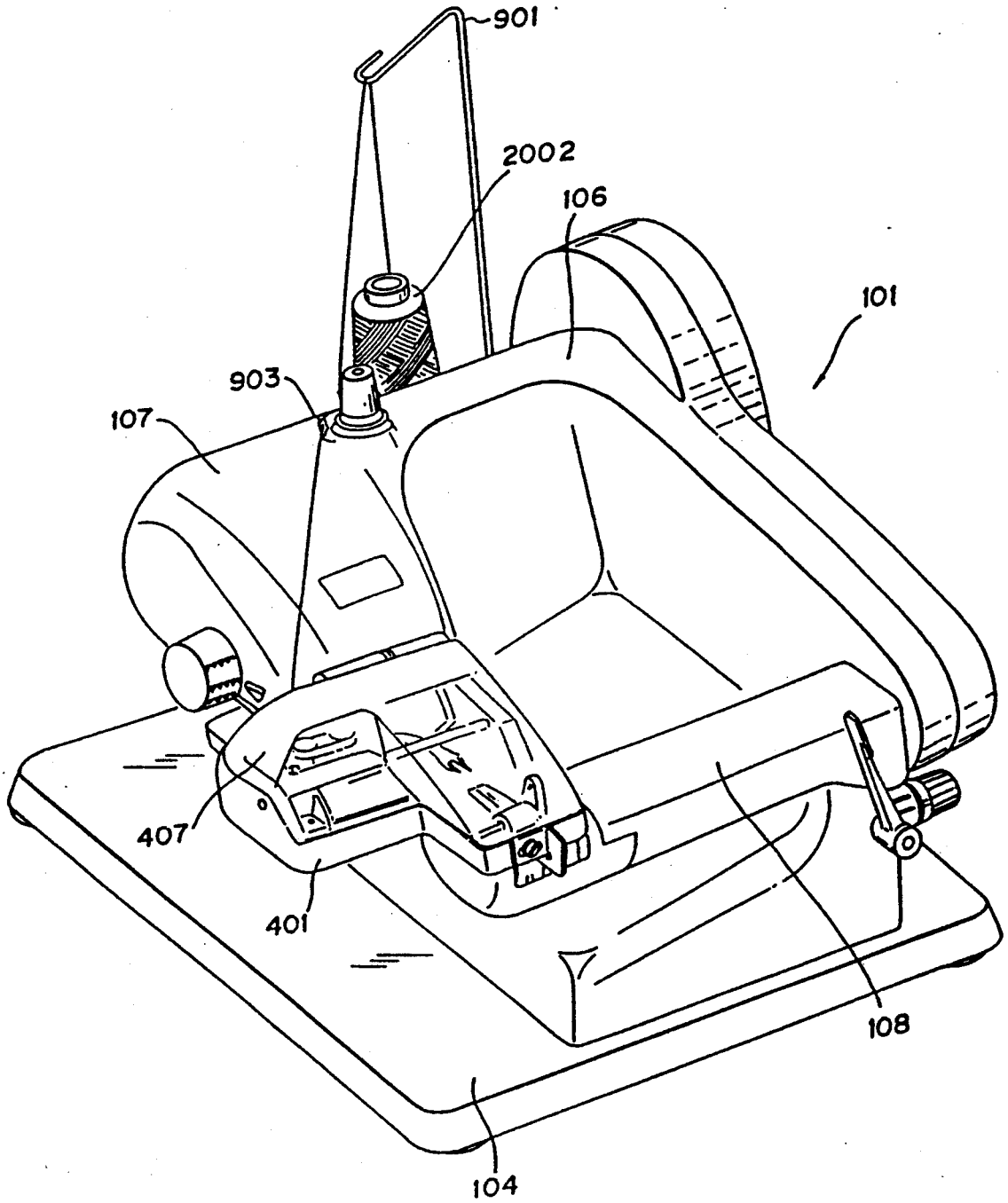
FIG. 1 is a perspective view showing the external appearance of one embodiment of the blind stitch sewing machine according to the present invention.

Referring to FIG. 1, the blind stitch sewing machine according to the present invention, roughly speaking, includes a machine frame 101, a machine base 104 for securing the machine frame 101, a machine cover 106, an arm cover 107, a cylinder cover 108, a needle plate 401 and a needle plate cover 407.

Figure 2:
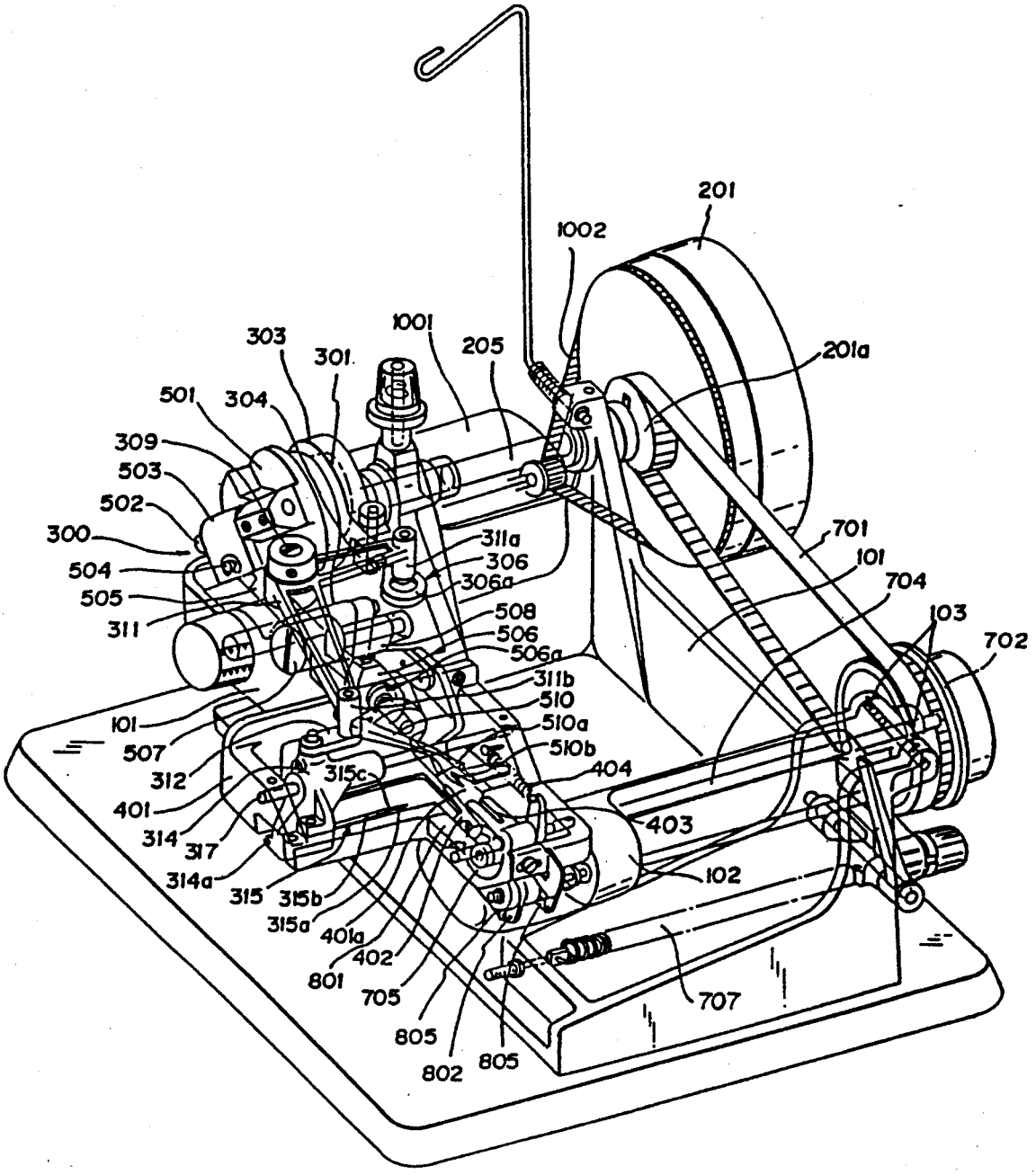
FIG. 2 is a perspective view showing the operating mechanism of the blind stitch sewing machine according to the present invention.

As shown in FIG. 2, the blind stitch sewing machine has a driving shaft 205. One end of the driving shaft 205 is rigidly secured to a flywheel 201 which is rotationally driven by a motor 1001 through a timing belt 1002. The other end of the driving shaft 205 is coupled to a straight needle 315 through a mechanism (described later) which gives a linear reciprocating motion to the straight needle 315. The second end of the driving shaft 205 is also coupled to a looper 510 through a mechanism (described later) which causes the looper 510 to move in such a manner that it is inverted at two ends of an ellipse.

Under the cylinder cover 108 is provided a cylinder 102. The needle plate 401 is mounted on the machine frame 101 at one end of the cylinder 102. A presser foot mount 802 which comprises a pair of right and left parts is pivotally attached to this end of the cylinder 102. The presser foot mount 802 has a presser foot 801 pivotally attached thereto and is biased by means of a spring 805 in a direction in which a workpiece 2001 (see FIG. 7) is clamped between the needle plate 401 and the presser foot 801.

Figure 5:
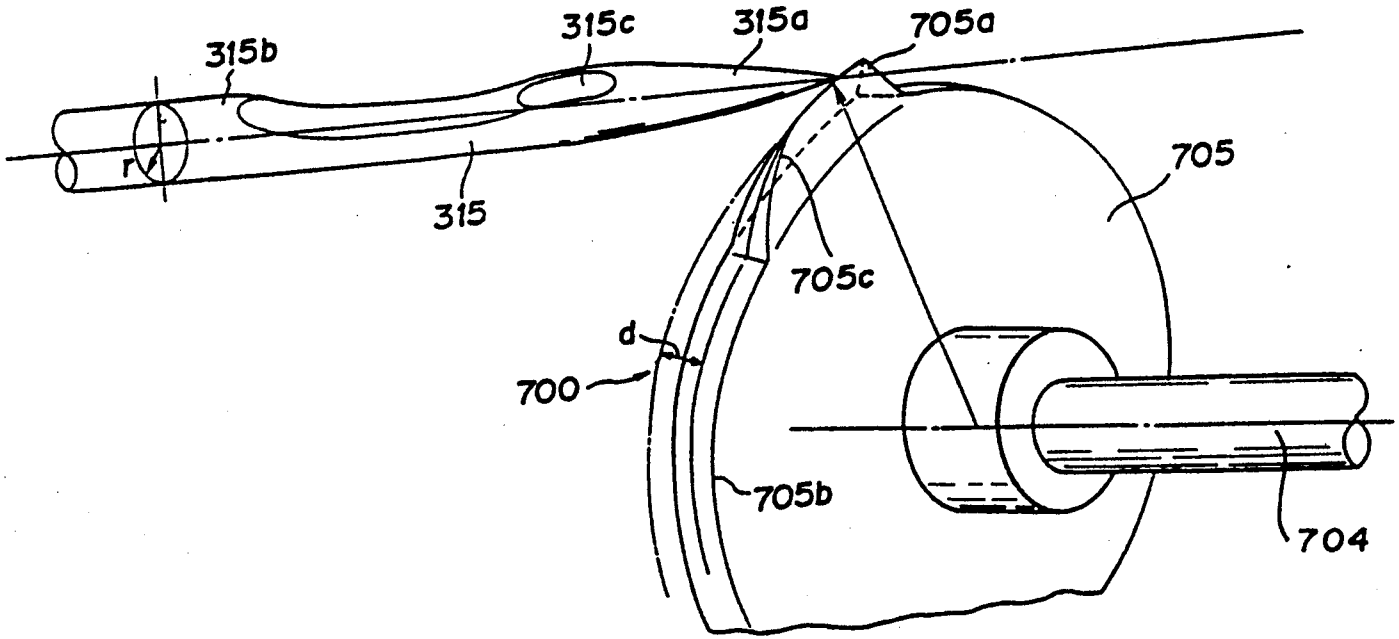
FIG. 5 shows the relationship between the work raising member and the needle in the blind stitch sewing machine according to the present invention.
Figure 6:
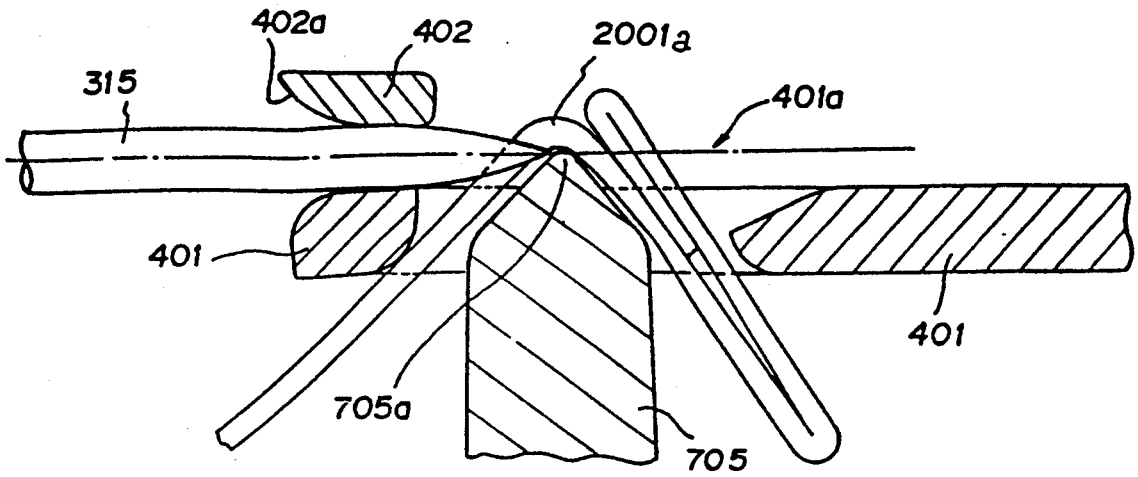
FIG. 6 shows the relationship between the needle and the needle guide in the blind stitch sewing machine according to the present invention.

Further provided are a work raising section 700 (see FIG. 5) including a work raising member 705 which raises a part **2001*a* of the work 2001 through an opening 401*a* provided in the needle plate 401 and a work holding-down member 403 which holds down the raised part 2001*a* of the work 2001** (see FIGS. 2 and 6).

The work raising member 705 is formed such that the upper or tip end thereof has an inverted V-shaped cross-section, and the work raising member 705 is rigidly secured to one end of a work raising shaft 704 which extends longitudinally through the center of the cylinder 102. The other end of the work raising shaft 704 is rigidly secured to a work raising pulley 702 which is coupled through a belt 701 to a timing pulley **201*a* rigidly secured to the flywheel 201**.

The work holding-down member 403 is formed so as to mate with the inverted V-shaped tip end of the work raising member 705. The work holding-down member 403 is pivotally attached to the needle plate 401 and biased by means of a work holding-down spring 404 in a direction in which it holds down the raised part **2001*a* of the work 2001** from the upper side thereof.

The blind stitch sewing machine according to the present invention is provided with a driving mechanism 300 (see FIGS. 2 and 3) between the driving shaft 205 and the straight needle 315 to give a linear reciprocating motion to the straight needle 315 in a direction which is parallel to the plane in which the work 2001 spreads, i.e., the directions X—X' and Y—Y' (see FIG. 7), and which is orthogonal to the sewing direction, i.e., the direction A (see FIG. 7), at least during the stitching process. The driving mechanism 300 comprises a needle driving eccentric cam 301 rigidly secured to the second end of the driving shaft 205 and a needle driving rod 303 which is connected to the cam 301 to convert the rotational motion of the driving shaft 205 into a linear reciprocating motion. The needle driving rod 303 has a connecting member 304 pivotally attached thereto. The outer race 306*a* of a universal ball joint 306 is rigidly secured to the connecting member 304. The ball of the ball joint 306 is rigidly secured to one end 311*a* of a bell crank-shaped needle driving arm 311 which is pivotally attached to a needle driving pivot shaft 309. Thus, the whole needle driving arm 311 is rocked by rocking the end 311*a* of the arm 311. The other end 311*b* of the needle driving arm 311 is pivotally attached to a needle retainer link 312 which is coupled to a needle retainer 314. The needle retainer 314 slides on a needle retainer shaft 317 rigidly secured to the needle plate 401 to convert the rocking motion into a linear reciprocating motion in the lateral direction, thereby giving a linear reciprocating motion to the straight needle 315 detachably secured to the needle retainer 314.

Figure 3:
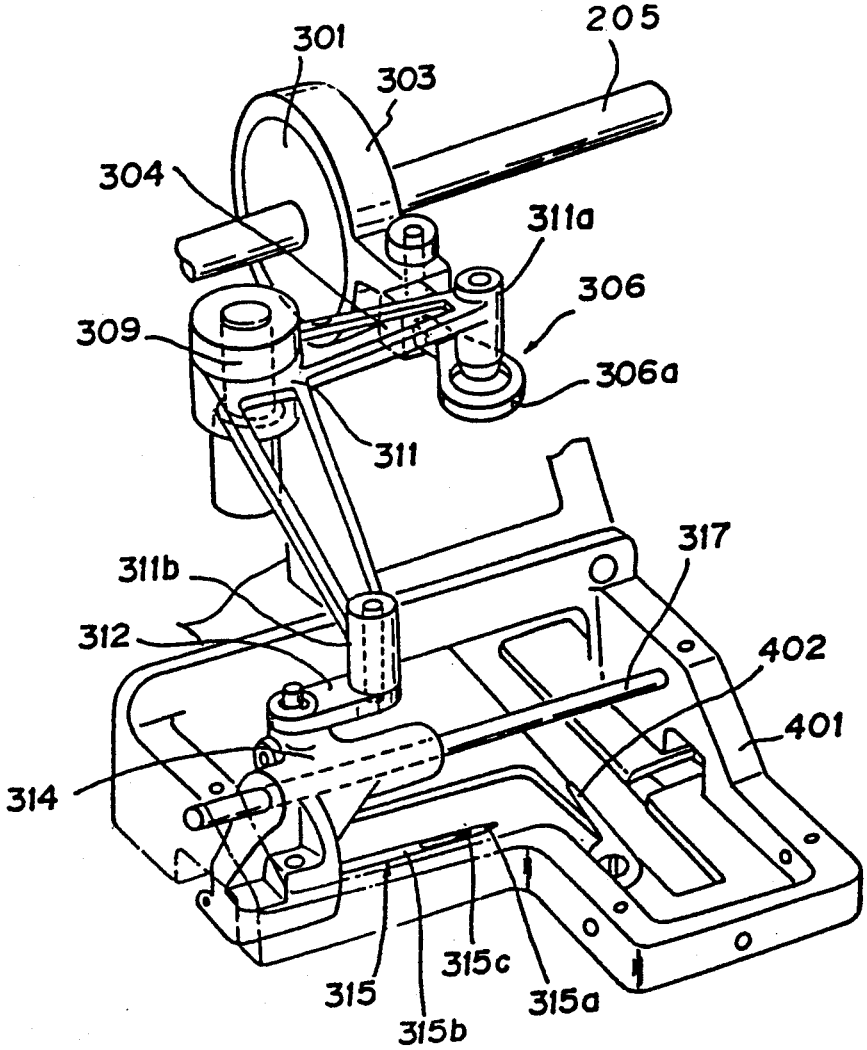
FIG. 3 is a perspective view showing in detail the needle driving mechanism of the blind stitch sewing machine according to the present invention.

The blind stitch sewing machine according to the present invention is further provided with a needle guide 402 (see FIGS. 2, 3 and 6). The needle guide 402 guides the straight needle 315 while pressing it in a direction counter to the work raising direction (the upward direction in the illustrated example) of the work raising member 705 with an inverted V-shaped tip end so as to prevent the straight needle 315 from sliding on the surface of the work 2001 without sticking therein. For this purpose, the needle guide 402 has a plate surface 402*a* which is slanted with respect to the direction of advance of the straight needle 315 in the illustrated example so that, as the straight needle 315 advances, the pointed tip 315*a* of the straight needle 315 slides along the slanting plate surface 402*a* and, as the needle 315 further advances, the trunk 315*b* of the needle 315 comes into contact with the needle guide 402, thus allowing the needle 315 to be guided while being pressed in the direction counter to the work raising direction of the work raising member 705.

It should be noted that, although in the foregoing embodiment the needle guide 402 is provided on the needle plate 401, it may be provided on the machine frame 101.

The blind stitch sewing machine according to the present invention is further provided with a work raising section 700 including a work raising member 705 which raises a part of the work 2001 through an opening 401*a* provided in the needle plate 401 and a work holding-down member 403 which holds down the raised part 2001*a* of the work 2001 (see FIGS. 2, 5, 6 and 7). The work raising member 705 carries a pair of edges members 705*a* having an inverted V-shaped cross-section and a wedge-shaped edge 705*c*. The peripheral edge of members 705*a* is slightly rounded as shown in FIG. 6. Work raising member 705 is rigidly secured to one end of a work raising shaft 704 longitudinally extending through the center of the cylinder 102, the other end of the shaft 704 being rigidly secured to a work raising pulley 702 which is coupled through a timing belt 701 to a timing pulley 201*a* secured to the flywheel 201, as described above.

The work holding-down member 403 is formed so as to mate with the inverted V-shaped edge 705*a* of the work raising member 705. The work holding-down member 403 is pivotally attached to the needle plate 401 and biased by means of a work holding-down spring 404 in a direction in which it holds down the raised part 2001*a* of the work 2001 from above.

In a preferred form of the present invention, the work raising member 705 is rigidly secured to one end of the work raising shaft 704 which is rotated in a relationship timed with the driving shaft 205 through the timing belt 701. As one example, the arrangement may be such that the work raising shaft 704 rotates a half turn per turn of the driving shaft 205, that is, the work raising shaft 704 is driven in a speed reduction ratio of 1:2 with respect to the driving shaft 205. The work raising member 705 has two of the peripheral edge members 705*a* with an inverted V-shaped cross-section which are formed on the outer periphery thereof in symmetry with each other so that the work 2001 is raised once per reciprocating motion of the straight needle 315, thus raising and keeping a part of the work 2001 in the raised position until it is stuck with the pointed tip 315*a* of the straight needle 315. In addition, the outer peripheral portions of the work raising member 705 which are between the inverted V-shaped edges 705*a* are recessed, as denoted by the reference numeral 705*b*, so that, after the pointed tip 315*a* of the straight needle 315 advancing has passed one inverted V-shaped edge member 705*a*, the edge 705*b* of work raising member 705 is below the axis of the needle 315 by a distance d which is not less than the radius r of the trunk 315*b* of the needle 315.

The end portion of the cylinder 102 where the work raising pulley 702 is rigidly secured is pivotally attached to the machine frame 101 through a pin 103 (see FIGS. 2 and 4) and biased by means of a cylinder spring 707 in a direction opposite that in which the work holding-down member 403 is pressed against the needle plate 401. The cylinder 102 has an arm portion 102*a* extending downward from the pivotally attached portion thereof. A blind stitching quantity adjusting screw 711 is in thread engagement with the arm portion 102 *a*. The distal end portion 711*a* of the screw 711 is in contact with the machine frame 101, and a blind stitching quantity adjusting knob 709 is rigidly secured to the other end 711*b* of the screw 711. Thus, by turning the adjusting knob 709, the work raising member 705 secured to one end of the work raising shaft 704 of the cylinder 102 is moved upward or downward, thereby varying the relative position of the inverted V-shaped edge 705*a* of the work raising member 705 with respect to the pointed tip 315*a* of the straight needle 315, and thus adjusting the blind stitching quantity.

Figure 7:
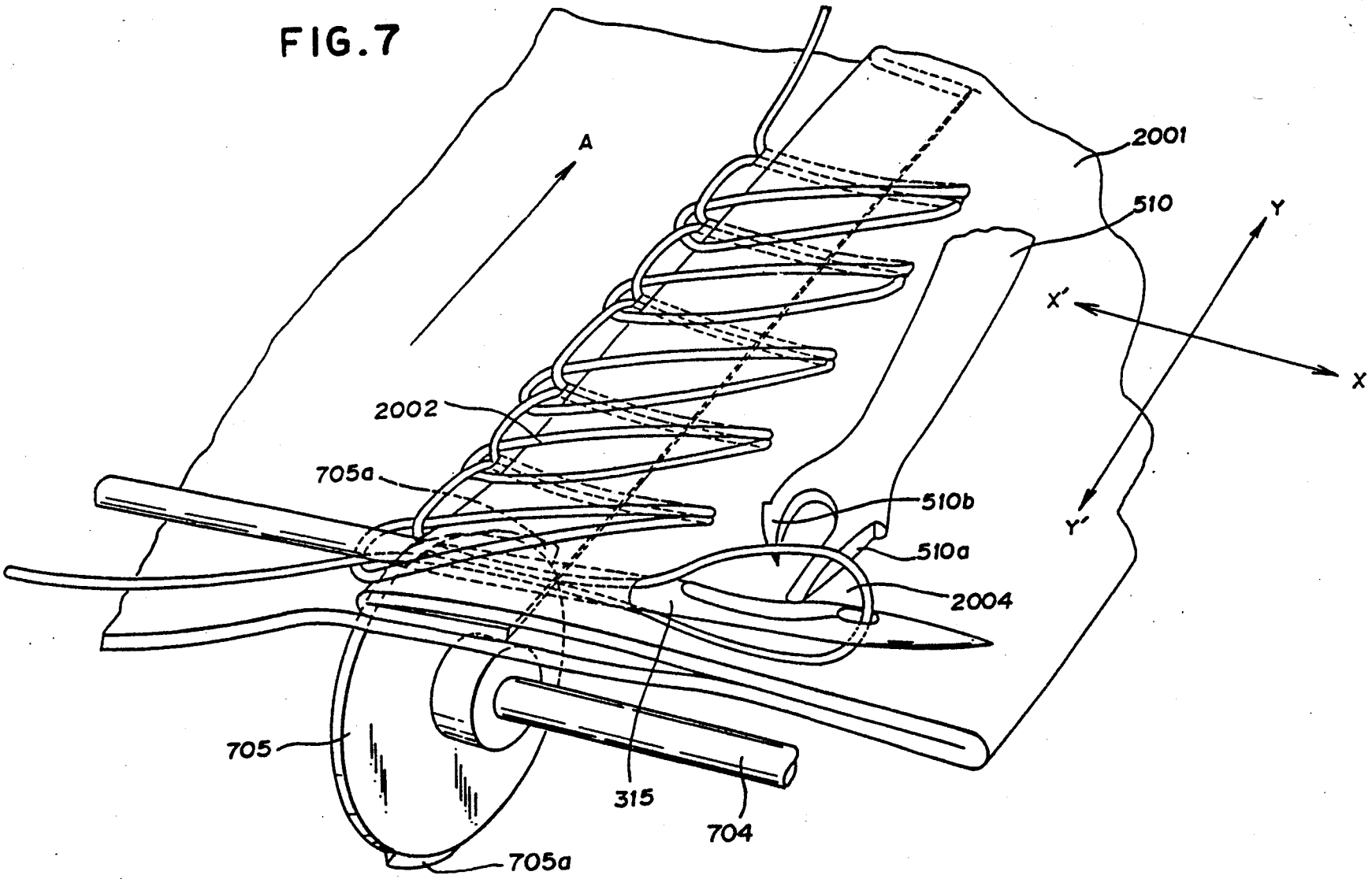
FIG. 7 shows the way in which blind stitching by a single-yarn chain stitch is performed by the cooperation of the needle and the looper of the blind stitch sewing machine according to the present invention.
Figure 8:
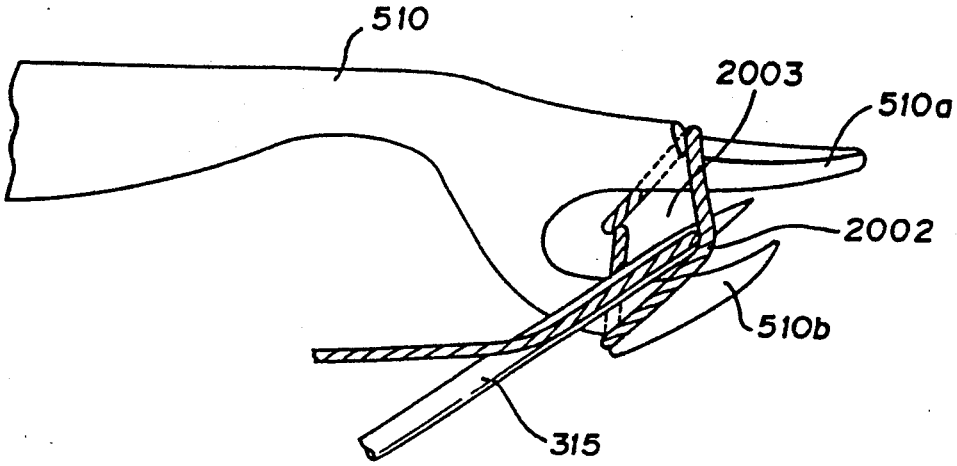
FIG. 8 shows the relationship between the needle and the looper of the blind stitch sewing machine according to the present invention.

The other, or second, end of the driving shaft 205 is also coupled to a looper 510 through a looper mechanism which causes the looper 510 to move in such a manner that it is inverted at two ends of an ellipse (see FIGS. 2, 7 and 8). More specifically, the second end of the driving shaft 205 is rigidly secured to a looper crank 501 which has a looper crank pin 502 rigidly secured thereto. A looper joint 503 is pivotally attached to the looper crank pin 502. One end of a looper rod 505 is pivotally attached to the looper joint 503 through a looper joint pin 504. The looper 510 is rigidly secured to the other end of the looper rod 505. To the looper rod 505 is rigidly secured the outer race 506*a* of a looper universal ball joint 506. The ball joint 506, in turn, rigidly secured to a looper rod mount 508. The ball of the universal ball joint 506 is rigidly secured to the end of the looper rod 505 where the looper 510 is rigidly secured. The looper rod mount 508 is pivotally attached to the machine frame 101 through a looper rod mount shaft 507.

The looper 510 has two horns 510*a* and 510*b* which define in combination a substantially U-shape, the horn 510*a* being slightly longer than the horn 510*b*.

A machine sewing thread 2002 (see FIG. 1) is guided through a thread guide bar 901 rigidly secured to the machine frame 101, a thread tension guide 903 and a thread guide portion 314*a* which is defined by a portion of the needle retainer 314, and the thread 2002 is passed through a needle's eye 315*c* bored in the pointed tip 315*a* of the needle 315.

Figure 9:
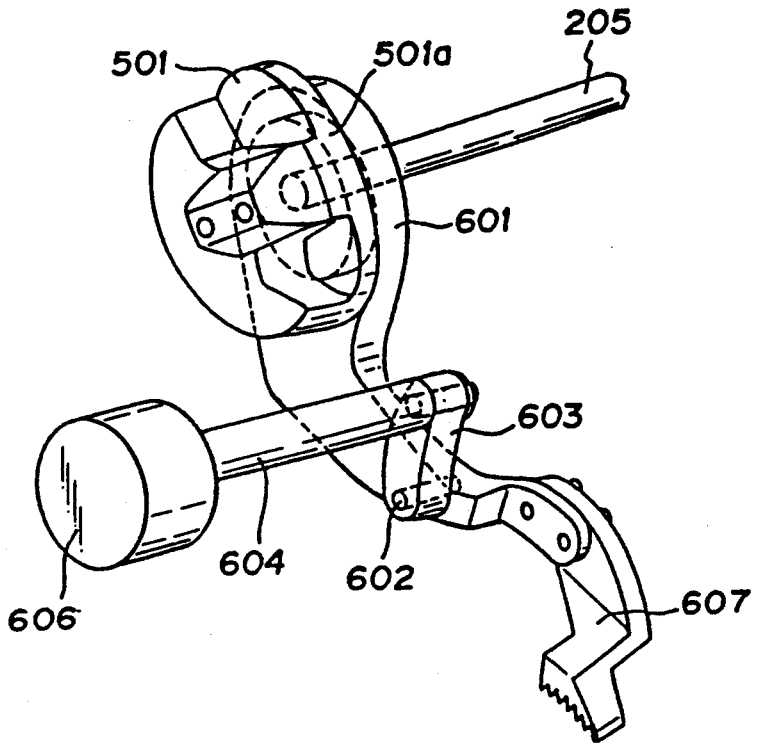
FIG. 9 is a perspective view showing the work feed mechanism of the blind stitch sewing machine according to the present invention.
Figure 10:
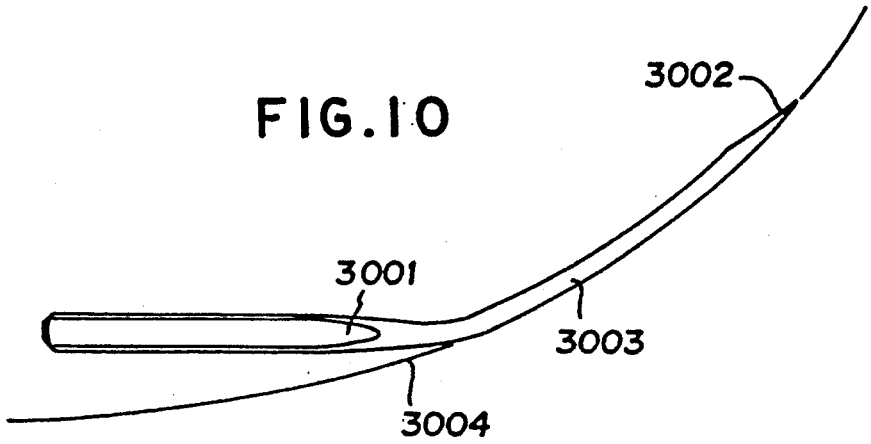
FIG. 10 is a side view of a curved needle which is used in a typical conventional blind stitch sewing machine.

A work feed eccentric cam 501*a* is formed on a portion of the looper crank 501 rigidly secured to the second end of the driving shaft 205 (see FIGS. 2 and 9). One end of a work feed rod 601 is pivotally attached to the work feed eccentric cam 501*a*, and a work feed member 607 is rigidly secured to the other end of the work feed rod 601. A feed adjusting link 603 is pivotally attached through an adjusting link pin 602 to the end portion of the work feed rod 601 where the work feed member 607 is rigidly secured. One end of a feed adjusting shaft 604 which is pivotally attached to the machine frame 101 is pivotally attached to the adjusting link 603, and a feed adjusting dial 606 is rigidly secured to the other end of the feed adjusting shaft 604.

The operation of the blind stitch sewing machine according to the present invention arranged as described above will next be explained together with the blind stitching method according to the present invention.

As the motor 1001 rotates, the driving shaft 205, together with the flywheel 201, rotates through the timing belt 1002. The rotational motion of the driving shaft 205 is converted into a linear reciprocating motion by means of the needle driving eccentric cam 301 and the needle driving rod 303 of the driving mechanism 300 (see FIGS. 2 and 3). By means of the connecting member 304 pivotally attached to the needle driving rod 303 and the needle driving universal ball joint 306, the bell crank-shaped needle driving arm 311 is pivoted, so that the needle retainer link 312 pivotally attached to the end 311*b* of the arm 311 causes the needle retainer 314 to slide on the needle retainer shaft 317 rigidly secured to the needle plate 401, thus driving the straight needle 315 detachably secured to the needle retainer 314 with a linear reciprocating motion per revolution of the driving shaft 205.

Simultaneously, as the driving shaft 205 rotates, the looper crank 501 having the looper crank pin 502 rigidly secured thereto rotates, so that the looper rod 505 moves back and forth, rotates clockwise and counterclockwise alternately and further performs a conical motion, i.e., a nutational motion, about the looper universal ball joint 506 through the looper joint 503 pivotally attached to the looper crank pin 502 since the looper rod 505 is suspended on the looper rod mount shaft 507 rigidly secured to the machine frame 101 through the looper universal ball joint 506 rigidly secured to the looper rod mount 508. As the looper rod 505 reciprocates while performing the nutational motion, the looper 510 that is rigidly secured thereto operates such that, during the advancing stroke of the looper 510, the horn 510*a* of the looper 510 catches the thread 2002 (see FIG. 7), and during the retracting stroke of the looper 510 after being turned about 90°, the horn 510*b* applies a tension to the thread 2002 caught by the horn 510*a* to form a loop 2003 of the thread 2002 and the needle 315 engages with and passes through the loop 2003 (FIGS. 7 and 8).

The work raising shaft 704 is timed to the driving shaft 205 through the timing belt 701. The work raising member 705 that is rigidly secured to one end of the work raising shaft 704 rotates a half turn per turn of the driving shaft 205, that is, the work raising shaft 704 is driven in a speed reduction ratio of 1:2 with respect to the driving shaft 205 and the inverted V-shaped edge member 705*a* raises the work 2001 once per reciprocating motion of the straight needle 315 (see FIGS. 5, 6 and 7). As the work raising member 705 rotates, the inverted V-shaped edge member 705*a* continuously raises the work 2001 until the pointed tip 315*a* of the straight needle 315 sticks in the raised part 2001*a* of the work 2001, and as the work raising member 705 further rotates, the work raising member 705 is withdrawn from the path of the needle 315 by a distance d which is not less than the radius r of the trunk 315*b* of the needle 315 by the presence of the cut portion 705*b* of the work raising member 705.

In addition, as the driving shaft 205 rotates, the work feed eccentric cam 501*a* formed on a portion of the looper crank 501 (see FIGS. 2 and 9) rotates and the work feed rod 601 reciprocates, thus causing the work feed member 607 to perform an elliptic motion to feed the work 2001 held between the needle plate 401 and the presser foot 801. It should be noted that, if the feed adjusting dial 606 is turned, the eccentric feed adjusting shaft 604 is turned to change the position of the adjusting link 603 in the vertical direction, thereby varying the length of contact between the toothed end of the work feed member 607 and the work 2001, and thus enabling adjustment of the work feed rate.

Figure 4:
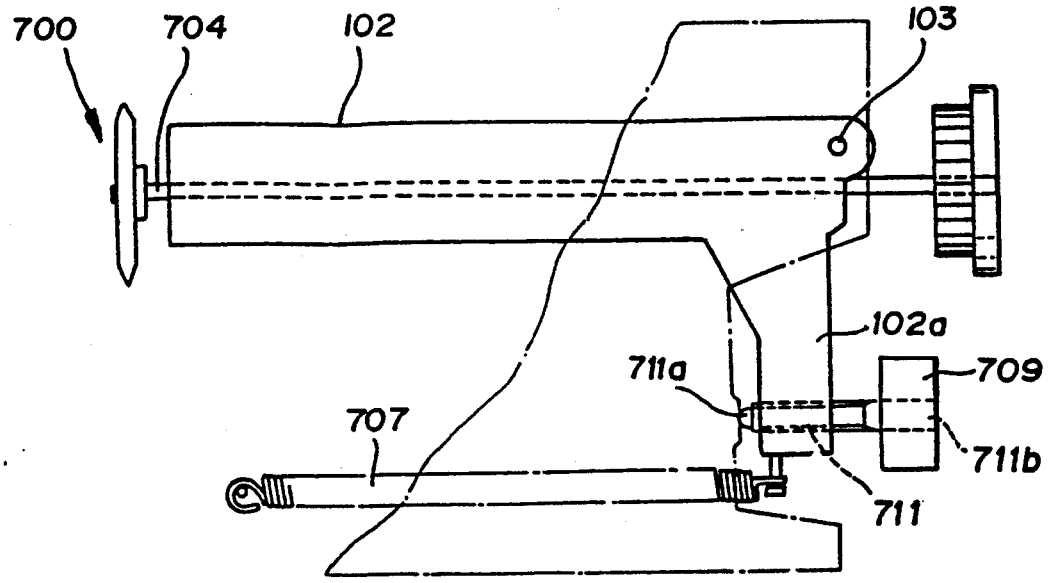
FIG. 4 is a fragmentary front view showing the blind stitching quantity adjusting mechanism of the blind stitch sewing machine according to the present invention.

If the blind stitching quantity adjusting screw 711 that is in thread engagement with the arm portion 102*a* of the cylinder 102 is turned by actuating the blind stitching quantity adjusting knob 709, since the distal end 711*a* the screw 711 is in contact with the machine frame 101, the work raising shaft 704 of the cylinder 102 is pivoted upward or downward, so that the work raising member 705 moves upward or downward, thereby varying the relative position of the inverted V-shaped edge 705*a* of the work raising member 705 with respect to the pointed tip 315*a* of the straight needle 315, and thus enabling the blind stitching quantity to be adjusted in accordance with the thickness of the work 2001 to be stitched (see FIGS. 4, 5 and 6).

The cooperative relationship between the straight needle 315, the looper 510, the work raising member 705 and the work feed member 607 will be explained below with reference to FIGS. 7 and 8.

As the driving shaft 205 rotates, the straight needle 315 is advanced through the needle driving mechanism 300. At the same time, the work raising member 705 rotates and the inverted V-shaped edge 705*a* of the work raising member 705 comes into contact with the work 2001 to raise a part 2001*a* of the work 2001 between the edge 705*a* and the work holding-down member 403. Thus, the advancing straight needle 315 sticks in the raised part 2001*a* of the work 2001, together with the thread 2002. At this time, the pointed tip 315*a* of the straight needle 315 advanced slides along the slanting plate surface 402*a* of the needle guide 402, and as the straight needle 315 further advances, the trunk 315*b* of the needle 315 comes into contact with the needle guide 402 and is then guided thereby while being pressed downward i.e. in a direction counter to the direction in which a part of the work 2001 is raised by the work raising member 705. More specifically, since the needle guide 402 guides the straight needle 315 while pressing it in the direction counter to the work raising direction (the upward direction as viewed in the illustrated example) of the work raising member 705, the straight needle 315 is prevented from, sliding on the surface of the work 2001 and is guided into the work 2001 without fail (see FIG. 6).

Next, as the straight needle 315 retracts, a loop 2004 of the thread 2002 is formed (see FIG. 7). During the advancing stroke of the looper 510, the horn 510*a* of the looper 510 catches the thread 2002 (see FIG. 7), and during the retracting stroke of the looper 510 after being turned about 90°, the horn 510*b* applies a tension to the thread 2002 caught by the horn 510*a* to form a loop 2003 of the thread 2002 and the needle 315 engages and passes through the loop 2003.

This operation is repeated to perform blind stitching by means of a single-yarn chain stitch in cooperation with the work feed operation conducted by the work feed member 607.

Thus, there is provided in accordance with the invention a blind stitch sewing machine which has the advantage discussed above. The embodiments described are. intended to be merely exemplary and those skilled in the art will be able to make variations and modifications in them without departing from the spirit and scope of the invention. All such modifications and variations are contemplated as falling within the scope of the claims.

What is claimed is:

1. A blind stitch sewing machine comprising:

a needle plate having an aperture;

a press member and spring means for biasing said press member against a first surface of said needle plate to clamp a workpiece therebetween;

work feed means for feeding the workpiece in a first linear path along said first surface of said needle plate as the workpiece is blind-stitched;

a straight needle mounted on the opposite side of said needle plate relative to said first surface;

a needle guide which, in cooperation with said needle plate, defines a confined straight path for the motion of said needle, said needle guide pressing said needle downward against said needle plate;

needle drive means for driving said needle with linear reciprocating motion in a second linear path, said second linear path being parallel to said needle plate and orthogonal to said first linear path during stitching;

work engaging means for pushing a portion of the workpiece through said aperture into said second path to allow said needle to pierce said workpiece; and a looper and looper drive means for driving said looper in synchronized cooperation with said motion of said needle to blind stitch the workpiece with a single-yarn chain stitch.

2. The blind stitch sewing machine of claim 1 wherein said first surface of said needle plate is its lowermost surface and said workpiece is pushed upwards through said aperture by said work engaging means.

3. The blind stitching machine of claim 1 further comprising a motor driven drive shaft and first means mounted on said drive shaft for driving said needle drive means and second means mounted on said shaft for driving said looper drive means.

4. The blind stitching machine of claim 3 wherein said first means is a cam and said needle drive means includes a rod driven with linear reciprocation by said cam and said second means is a crank and said looper drive means includes a joint member pivotally connected to said crank at a point offset from the axis of rotation of said drive shaft.

5. The blind stitch sewing machine of claim 1 further comprising work holding means for holding in position for stitching that portion of the workpiece delivered through said aperture by said work engaging means.

6. The blind stitch sewing machine of claim 5 wherein said work engaging means is a rotatable disk having an inverted V-shaped peripheral portion and said work holding means has a V-shaped groove which mates with said V-shaped peripheral portion of said work engaging means.

7. A blind stitch sewing machine comprising:

a needle plate having an aperture;

a press member and spring means for biasing said press member against a first surface of said needle plate to clamp a workpiece therebetween;

work feed means for feeding the workpiece in a first linear path along said first surface of said needle plate as the workpiece is blind-stitched;

a straight needle having a trunk tapering to a point and mounted on the opposite side of said needle plate relative to said first surface;

needle drive means for driving said needle with linear reciprocating motion in a second linear path, said second linear path being parallel to said needle plate and orthogonal to said first linear path during stitching;

work engaging means for pushing a portion of the workpiece through said aperture into said second path to allow said needle to pierce said workpiece, said work engaging means comprising a rotatably driven disk mounted in a plane perpendicular to said needle plate and means for driving said disk with continuous rotation, said disk having a circumference spaced from the trunk of said needle and at least one protrusion extending radially from said circumference of said disk to a peak, said peak travelling in a circle as said disk rotates, said circle intersecting said second linear path, the peak of said protrusion extending outwardly of said circumference by a distance at least equal to the radius of said trunk of said needle; and a looper and looper drive means for driving said looper in synchronized cooperation with said motion of said needle to blind stitch the workpiece with a single-yarn chain stitch.

8. The blind stitch sewing machine of claim 7 wherein said disk carries a plurality of said protrusions symmetrically positioned on said periphery.

9. The blind stitch sewing machine of claim 8 wherein said disk carries two of said protrusions and rotates a half turn per reciprocating motion of the needle.

10. The blind stitch sewing machine of claim 7 wherein each protrusion has at least one surface sloping away from said peak in a direction counter to the rotation of said disk to a juncture with said circumference, said sloping surface defining a radius for said disk which gradually diminishes from a maximum at said peak to a minimum at said juncture.

* * * * *